US006186737B1

(12) United States Patent
Cohen

(10) Patent No.: US 6,186,737 B1
(45) Date of Patent: Feb. 13, 2001

(54) STORAGE HOLDER FOR ELASTIC BANDS

(76) Inventor: Donald K. Cohen, 37910 Carson St., Farmington Hills, MI (US) 48331

( * ) Notice: Under 35 U.S.C. 154(b), the term of this patent shall be extended for 0 days.

(21) Appl. No.: 09/323,391

(22) Filed: Jun. 1, 1999

(51) Int. Cl.[7] ..... B65H 75/06; B65D 85/67

(52) U.S. Cl. ..... 414/800; 206/303; 206/338; 206/495; 206/805; 242/613.3

(58) Field of Search ..... 414/800, 27; 206/303, 206/338, 495, 805, 49, 388, 63.3, 37.1; 221/33, 34, 35, 312 C, DIG. 1; 242/166, 570, 585, 587, 587.2, 588, 613.3, 603, 222

(56) References Cited

U.S. PATENT DOCUMENTS

| | | | | |
|---|---|---|---|---|
| 130,672 | * | 8/1872 | Sutro | 242/613.3 X |
| D. 266,009 | * | 8/1982 | Carney | D19/75 |
| 440,812 | * | 11/1890 | Keats | 242/613.3 X |
| 2,328,522 | * | 8/1943 | Yocum | 206/495 X |
| 3,858,719 | * | 1/1975 | Isaacs | 206/805 X |
| 3,918,132 | * | 11/1975 | McGahee | 206/338 |
| 4,258,843 | * | 3/1981 | Wymer | 206/63.3 |
| 4,890,730 | | 1/1990 | Kovac | 206/495 X |
| 5,487,466 | * | 1/1996 | Robson | 206/805 X |
| 5,909,809 | * | 6/1999 | Franklin | 206/805 X |

FOREIGN PATENT DOCUMENTS

| | | | | |
|---|---|---|---|---|
| 2 777 553 | * | 10/1999 | (FR) | 206/495 |
| 2 017 047 | * | 10/1979 | (GB) | 206/495 |

* cited by examiner

*Primary Examiner*—Robert P. Olszewski
*Assistant Examiner*—Gerald J. O'Connor

(57) ABSTRACT

A method for storing elastic bands makes use of an annular storage device, larger in diameter than the unstretched length of the elastic bands to be stored. The device has a series of clogs around its circumference, thereby creating a recessed area between each pair of adjacent clogs. The elastic bands to be stored are sequentially applied to the device, each elastic band being stretched between diametrically opposed recesses, thereby spanning the center. The elastic bands are then later removed in reverse order, as needed.

3 Claims, 3 Drawing Sheets

STORAGE HOLDER FOR ELASTIC BANDS

BACKGROUND OF THE INVENTION

Rubber bands are frequently accumulated in various locations, either through the internal movement of office correspondence or from other sources such as through the mail. The tendency is to save the rubber bands for use when needed. Typically, the rubber bands are thrown into a box or in a desk drawer. They tend to become attracted to one another so that when the user wants to use a single rubber band, he has to separate it from a mass of other rubber bands that may be of either the same or other sizes. It is inconvenient and time-consuming to separate such rubber bands.

Prior art related to this invention includes U.S. Pat. No. 4,890,730 issued Jan. 2, 1990, to John Kovac for "Elastic Band Holder". This holder has pairs of opposed slots around which a rubber band is stretched and stored. Several pairs of slots spaced at different distances accommodate rubber bands of different lengths. The rubber bands are stretched around their particular pair of slots in contact with other rubber bands of the same size.

SUMMARY OF THE INVENTION

The broad purpose of the present invention is to provide a rubber band holder which permits several rubber bands to be stored. The rubber bands are stretched around the holder so they are substantially out of contact and disposed over the previously mounted rubber bands.

The preferred embodiment of the invention comprises an annular plate-like holder having a series of spaced cogs around a circular periphery forming opposed notches around the entire edge of the holder. The edge of the holder is blunt to prevent damage to the stretched rubber bands. The diameter of the holder is greater than the natural unstretched diameter of the rubber bands so that they must be stretched to be mounted on the holder.

Each rubber band is stretched around the holder, disposed in notches on opposite sides of the holder with the midsection of the rubber band closely adjacent the center of the holder. This permits the individual rubber bands to be substantially out of contact with the other rubber bands as they are being placed on the holder. Further it permits the last rubber band placed on the holder to be the first available for removal. It can be removed without becoming tangled with the other rubber bands.

Still further objects and advantages of the invention will become readily apparent to those skilled in the art to which the invention pertains upon reference to the following detailed description.

DESCRIPTION OF THE DRAWINGS

The drawings illustrate a preferred embodiment of the invention in which like reference characters refer to like characters throughout the several views, and in which.

DESCRIPTION OF THE PREFERRED EMBODIMENT

Figure 2:
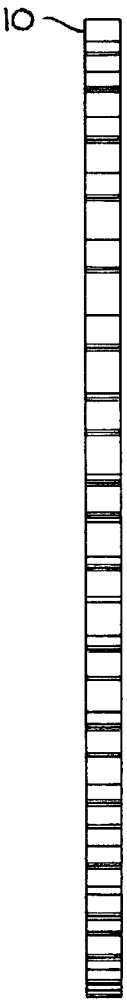
FIG. 2 is a view as seen from the right side of FIG. 1.
Figure 1:
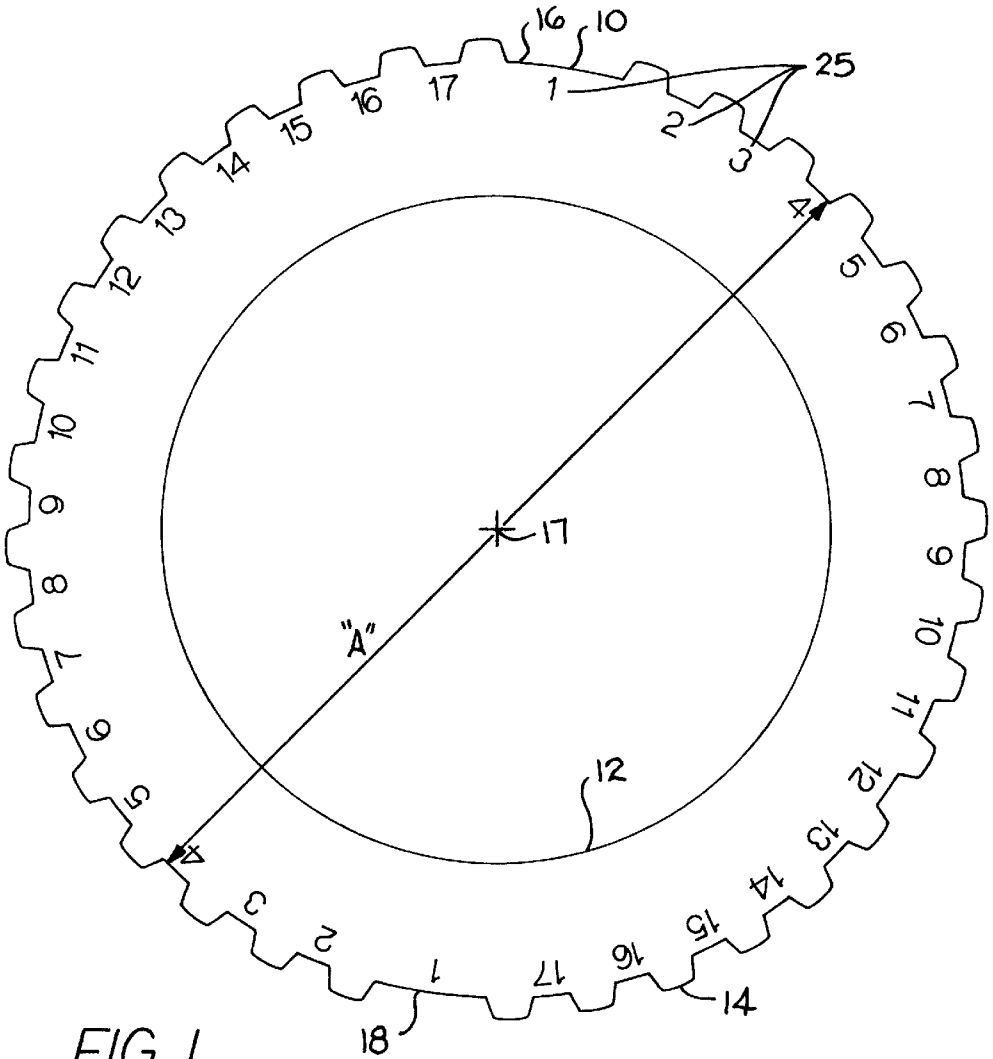
FIG. 1 is a view of a holder illustrating the preferred embodiment of the invention.
Figure 3:
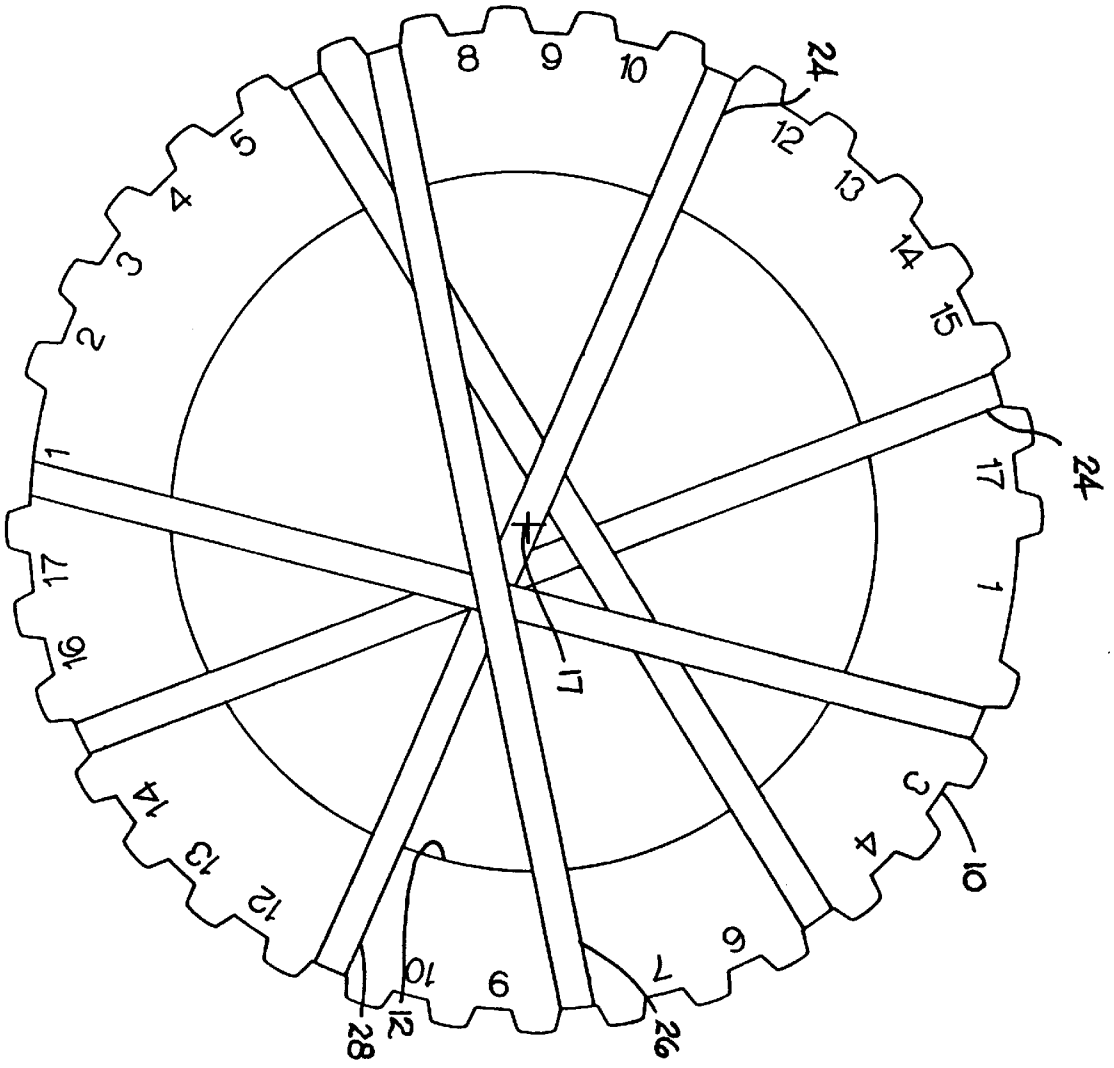
FIG. 3 is a view of the holder of FIG. 1 with several rubber bands mounted around the holder.

Referring to the drawings, FIGS. 1–3 illustrate a preferred holder 10, which for illustrative purposes, comprises a plate-like body having an outer diameter "A" of about 5½". For convenience, the holder has an inner circular opening 12 of about 3¾" for hanging the holder on a hook or the like.

For illustrative purposes, the holder has an outer, annular edge surface with 34 cogs 14 spaced around the holder. The cogs are preferably equally spaced apart, except for a pair of end notches 16 and 18, to define a plurality of spaced equal notches around the holder for receiving rubber bands.

The holder annular edge is formed about a center 17. The holder has a thickness of about ⅛".

Figure 4:
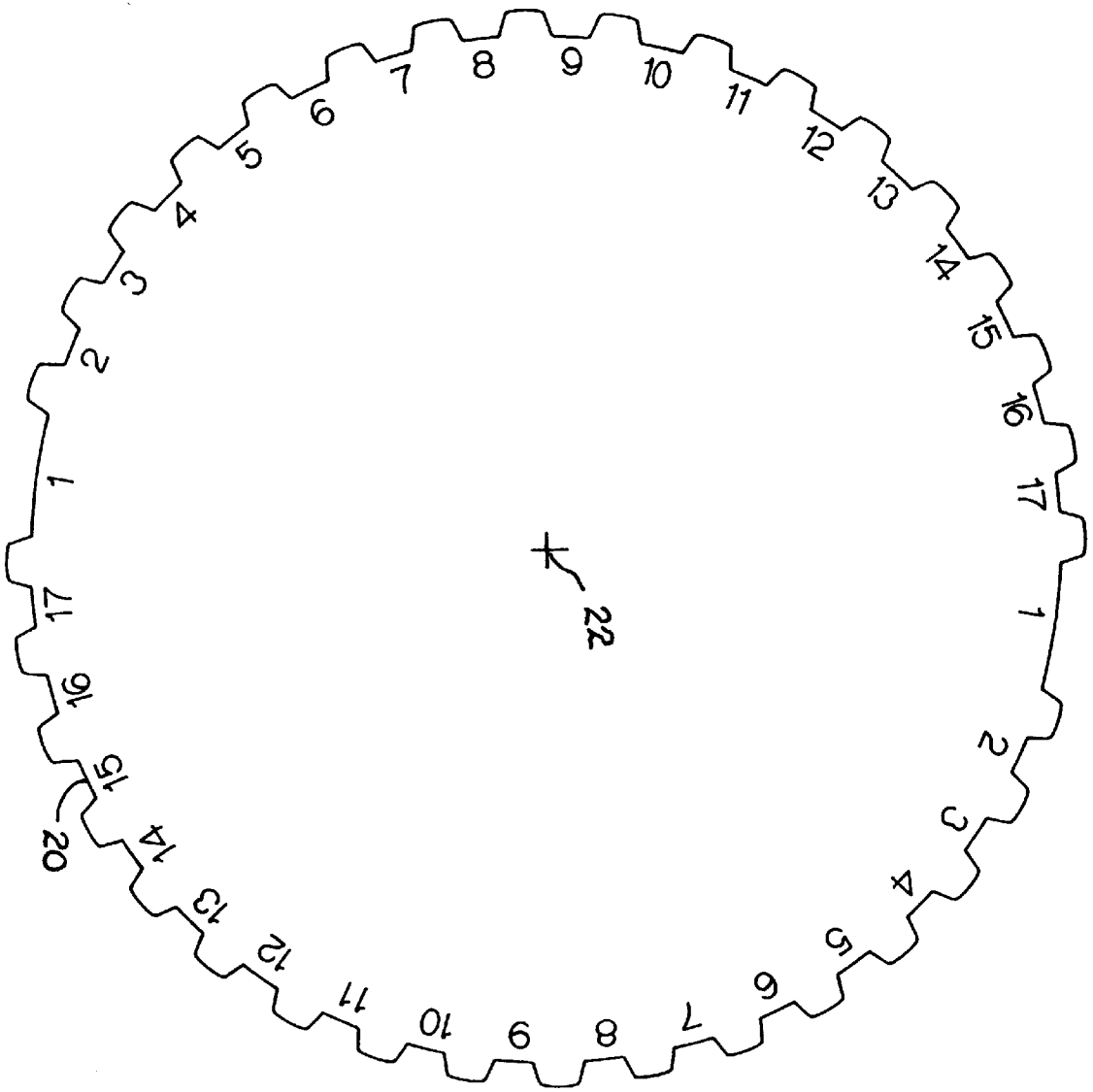
FIG. 4 illustrates another embodiment of the invention.

The holder may be made of metal or a durable plastic with sufficient rigidity so that it will not buckle when several rubber bands are stretched on the notches. The holder may also be formed, as illustrated in FIG. 4, in which body 20 has either a greater or a lesser number of cogs, and without the internal opening, but with a center 22 generally defining the center of the outer annular edge.

In use and as illustrated in FIGS. 2 and 3, five rubber bands 24 are mounted on the holder.

Each notch of the holder is marked with an indicia 25. The indicia are in two series labeled 1–17. Like numbers of each series are on opposite sides of center 17. Each rubber band is stretched around opposite side edges of the holder, so that the midsection of each band is proximate center 17 of the holder. The rubber bands are mounted in a sequence in which the innermost rubber band is first and the outermost rubber band is last. Each rubber band is stretched over the previously mounted bands.

The rubber bands have minimal contact with one another in their stretched condition and therefore resist being tangled together. Further, it is relatively easy to remove the last rubber band, in this case 26 from the holder for use. The next rubber band 28 will then be removed and each subsequent rubber band can be removed without being tangled with the remaining rubber bands. Further, additional rubber bands can be mounted on the holder preferably in separate pairs of opposed notches from the previous rubber bands.

The diameter of the holder is sufficient to stretch the rubber bands so that they are securely mounted on the holder.

Each successive rubber band is disposed outside the previous rubber band in the area of contact.

Having described my invention, I claim:

1. A method for storing elastic bands comprising the steps of:

providing a storage member having an annular surface having a center, and a diameter greater than the unstretched length of elastic bands that are to be stored thereon; and mounting the elastic bands sequentially over the annular surface of the storage member, each of the bands being mounted on two opposite positions on the annular surface on opposite sides of the center, said positions being disposed in spaced circumferential locations on said annular surface and the midsection of each elastic band being disposed adjacent the center of the annular surface, each band being disposed over the previously mounted bands in a first sequence and being individually removable in a reverse sequence.

2. A method as defined in claim 1, in which the storage member has a series of circumferentially spaced clogs, and including the step of stretching a rubber band over a recess between adjacent clogs on opposite sides of the storage member.

3. A method as defined in claim 1, in which the storage member has a series of spaced recesses around the annular outer surface, and including the step of marking the individual recesses with identifying indicia.

* * * * *